US008222819B2

(12) United States Patent
Wei et al.

(10) Patent No.: US 8,222,819 B2
(45) Date of Patent: Jul. 17, 2012

(54) CERAMIC DISCHARGE VESSEL HAVING AN OPAQUE ZONE AND METHOD OF MAKING SAME

(75) Inventors: George C. Wei, Weston, MA (US); Christopher A. Tarry, Portsmouth, NH (US); Roland Huettinger, Kaufering (DE)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 13/205,331

(22) Filed: Aug. 8, 2011

(65) Prior Publication Data

US 2011/0291558 A1 Dec. 1, 2011

Related U.S. Application Data

(62) Division of application No. 11/851,802, filed on Sep. 7, 2007, now Pat. No. 8,040,061.

(51) Int. Cl.

| | |
|---|---|
| ***H01J 17/49*** | (2012.01) |
| ***H01J 17/00*** | (2006.01) |
| ***H01J 17/16*** | (2012.01) |
| ***H01J 17/20*** | (2012.01) |

(52) U.S. Cl. ..... 313/636; 313/567; 313/637; 445/23

(58) Field of Classification Search ..... None
See application file for complete search history.

(56) References Cited

U.S. PATENT DOCUMENTS

| | | | | |
|---|---|---|---|---|
| 6,200,918 | B1 * | 3/2001 | Yanagitani et al. | 501/152 |
| 6,583,563 | B1 * | 6/2003 | Venkataramani et al. | 313/634 |
| 6,791,266 | B2 * | 9/2004 | Venkataramani et al. | 313/623 |
| 6,878,456 | B2 * | 4/2005 | Castro et al. | 428/542.8 |
| 8,040,061 | B2 * | 10/2011 | Wei et al. | 313/567 |
| 2006/0273728 | A1 * | 12/2006 | Born et al. | 313/638 |
| 2007/0132396 | A1 * | 6/2007 | Van Gennip et al. | 313/625 |

* cited by examiner

*Primary Examiner* — Natalie Walford
(74) *Attorney, Agent, or Firm* — Robert F. Clark

(57) ABSTRACT

An opaque zone in the polycrystalline (PCA) discharge vessel of a high intensity discharge lamp may be made by creating residual pores in predetermined regions of the final-sintered discharge vessel. The control over the placement of the opaque zone is achieved by forming a carbonaceous residue in a specific region of the discharge vessel prior to final sintering. During sintering, the carbonaceous material causes residual porosity in the sintered PCA. The higher emissivity of the opaque PCA provides localized cooling in order to provide more control over the condensate behavior in the discharge vessel.

6 Claims, 1 Drawing Sheet

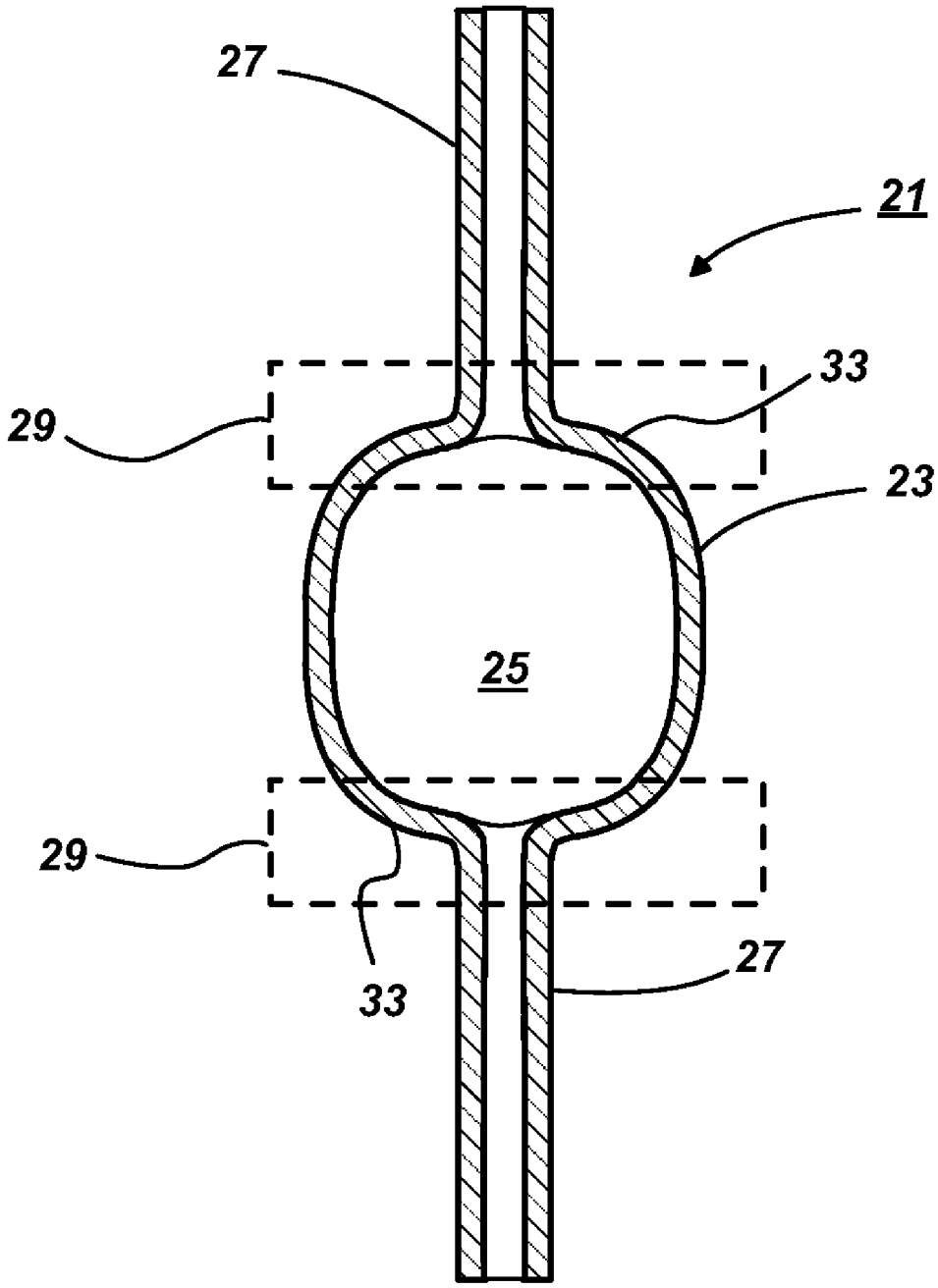
27
21
33
29
23
25
29
33
27

CERAMIC DISCHARGE VESSEL HAVING AN OPAQUE ZONE AND METHOD OF MAKING SAME

CROSS REFERENCES TO RELATED APPLICATIONS

This application is a divisional of application Ser. No. 11/851,802, filed Sep. 9, 2007, now U.S. Pat. No. 8,040,061 which is hereby incorporated by reference.

TECHNICAL FIELD

This invention relates to ceramic discharge vessels for high intensity discharge (HID) lamps, and, more particularly, to polycrystalline alumina (PCA) discharge vessels for metal halide lamps.

BACKGROUND OF THE INVENTION

Metal halide discharge lamps are favored for their high efficacies and high color rendering properties which result from the complex emission spectra generated by their rare-earth chemistries. Particularly desirable are ceramic metal halide lamps which offer improved color rendering, color temperature, and efficacy over traditional metal halide lamps having quartz discharge vessels. This is because ceramic discharge vessels can operate at higher temperatures than their quartz counterparts and are less prone to react with the various metal halide chemistries.

Most commercial ceramic metal halide lamps contain a fill comprising an amount of mercury and a complex combination of metal halides, particularly iodides. The fill chemistries of metal halide lamps are carefully selected to achieve a white light emission having a high color rendering index (CRI) and a high efficacy (lumens/watt, LPW). The condensation and evaporation behavior of the fill materials within the discharge vessel (also commonly referred to as an arc tube) affects the performance of the lamps over their operating life. A lack of control over this behavior can lead to unpredictable changes in the lamp's correlated color temperature (CCT) or CRI. Thus, it is desirable to have a well-defined region for the condensate to form in the discharge vessel so that the metal halide lamps have more stable color characteristics.

Various means for controlling the condensation-evaporation behavior of metal halide and similar metal amalgam fills have been developed for use with different types of HID lamps. For example, reflective coatings, in particular $ZrO_2$, have been applied on the outside surface of quartz arc tubes in metal halide lamps, and metal heat shields have been wrapped around the cold ends of small-wattage high-pressure sodium (HPS) arc tubes. For ceramic metal halide lamps, prior-art approaches to achieve a well-defined, small-size cold spot, include the use of asymmetric electrode feedthroughs and minimizing the space between the feedthrough and wall of the discharge vessel.

SUMMARY OF THE INVENTION

At high temperatures, the emissivity ($\epsilon$) of the ceramic material used to form the walls of the discharge vessel affects the wall temperature—the lower the emissivity, the greater the wall temperature. For example, forming arc tubes from yttria has been shown to increase wall temperatures by about 100° C. Yttria has a lower emissivity than polycrystalline alumina, about 0.1 compared to about 0.2 for PCA at about 1000° C. Conversely, a higher emissivity material will result in a lower wall temperature.

The emissivity of polycrystalline alumina is related to its transmittance. Opaque PCA has a high total emittance value of about 0.4 at 1000° C., whereas translucent PCA typically has a total emittance value of about 0.2 at 1000° C. The difference in emissivity between opaque and translucent PCA is sufficient to alter the wall temperature in specific regions of the discharge vessel in order to promote condensation of the metal halide fill.

Although an opaque ceramic would not normally be thought of as desirable for a discharge vessel, the inventors have discovered that it is possible to form a reasonably well-defined opaque zone in a polycrystalline alumina discharge vessel. Because the location and extent of the opaque zone can be manipulated, the opaque zone may be designed to minimize any negative effect on the light output of the discharge vessel. The control over the placement of the opaque zone is achieved by forming a carbonaceous residue in a specific region of the discharge vessel prior to final sintering. During sintering, the carbonaceous material causes residual porosity in the sintered PCA. The residual pores inside the alumina grains scatter and absorb light causing opaqueness and higher emissivity. In the context of this invention, the term "opaque" means that incident light is scattered to such a degree that the PCA is no longer translucent. This manifests as a visually perceivable change in the appearance of the PCA which ranges from a frosted glass appearance to completely white.

The tailored opaque zone is intended to provide a cooler, localized temperature region in the discharge vessel to control the location of the metal halide condensate so as to produce a better lamp-to-lamp consistency and less spread in CCT and CRI over a lamp's operating life. This method is more effective and more durable than for example applying a high emissivity coating to the surface which can peel off discharge vessel as a result of thermal expansion mismatches and repeated heating and cooling cycles. Moreover, the opaque zone may be made at any location and of any configuration and size without redesigning the discharge vessel. Besides not requiring tooling changes, this has the added benefit of keeping the thermal mass of the discharge vessel the same as the original design so that the operating characteristics are relatively unchanged.

In one aspect of the invention, there is provided a method for forming an opaque zone in a ceramic discharge vessel. The method comprises (a) forming a discharge vessel from a mixture of alumina and an organic binder; (b) firing the discharge vessel shape to remove the organic binder and form a prefired discharge vessel; (c) applying a solution of an organic compound to a surface of the prefired discharge vessel in a predetermined region; (d) firing the prefired discharge vessel in a nitrogen or inert gas atmosphere to form a carbonaceous residue in the predetermined region; and (e) sintering the prefired discharge vessel to form an opaque zone in the predetermined region.

BRIEF DESCRIPTION OF THE DRAWINGS

The FIGURE is a cross-sectional illustration of a ceramic discharge vessel showing a preferred region for the placement of an opaque zone(s).

DETAILED DESCRIPTION OF THE INVENTION

For a better understanding of the present invention, together with other and further objects, advantages and capabilities thereof, reference is made to the following disclosure and appended claims taken in conjunction with the above-described drawing.

An opaque PCA zone may be made by creating residual pores in predetermined regions of the final-sintered discharge vessel. Studies have shown that the opaqueness-causing residual pores are entrapped inside grains that have no apparent negative side effects on the discharge vessel. A compilation of data from several studies of opaque and translucent PCA is given in the following table.

| | Scattering coefficient at 600 nm ($cm^{-1}$) | Average pore size μm), and range of pore sizes (μm) | Pore population (# of pores per $mm^3$) |
|---|---|---|---|
| Opaque PCA | 28 to 48 | ~2, 0 to 5 | 1 to $4 \times 10^6$ |
| Translucent PCA | 10 to 20 | ~1, 0 to 3 | 4 to $5 \times 10^5$ |

Accordingly, the opaque zone of this invention preferably has a scattering coefficient at 600 nm equal to or greater than 28 $cm^{-1}$ and, more preferably 28 to 48 $cm^{-1}$. The pore population of the opaque zone is preferably equal to or greater than $1\times10^6$ pores per $mm^3$ with a preferred average pore size of about 2 μm. More preferably, the opaque zone has a pore population of from 1 to $4\times10^6$ pores per $mm^3$.

A preferred method for generating the residual pores involves the application of a solution of an organic compound such as polyvinyl alcohol into the targeted area after the green state ceramic shape has been fired to remove the organic binder and to confer strength to the part. This binder removal step is typically conducted in air and is generally referred to as prefiring because it is prior to the final firing used to sinter the part. After the binder has been removed and the organic compound applied to the targeted area, the part is given a second prefiring in an inert gas (e.g., argon or helium) or nitrogen so that a carbonaceous residue is left behind in the prefired body. Preferably, the second prefiring is conducted at a temperature from about 700° C. to about 1400° C. and, more preferably, at about 900° C.

The prefired discharge vessel is then subjected to a final sintering at a temperature from about 1750° C. to about 1950° C., typically in a hydrogen-containing atmosphere, e.g., wet $H_2$, or wet 75% $H_2$/25% $N_2$. The region containing the carbonaceous residue becomes an opaque zone after the final sintering in a hydrogen-containing atmosphere. The method is flexible enough to be used with any discharge vessel construction and is capable of forming opaque zones of almost any shape and size.

The figure is a cross-sectional illustration of an arc discharge vessel according to a preferred embodiment of this invention. The arc discharge vessel 21 has a ceramic body 23 which is comprised mainly of translucent polycrystalline alumina. The body 23 defines an arc discharge cavity 25 and has two capillaries 27 extending outwardly in opposite directions from the discharge cavity 25. Preferably, the thickness of the discharge cavity wall is about 0.8 mm. The capillaries are suitable for receiving, and sealing therein, electrode assemblies (not shown) which provide a conductive path for supplying electric power to the discharge vessel in order to strike and sustain an arc within the discharge cavity.

Substantially hemispherical ends 33 yield a temperature distribution in the operating discharge vessel that is more uniform than in a cylindrical tube. While the more uniform distribution is preferred for many aspects of lamp performance, this does not provide a well-defined cold corner inside the discharge vessel where the rare earth halides will consistently reside. A consistent 'cold spot' is beneficial in order to produce a narrow spread in color within a group of a large number of the same kind of lamps.

In view of this, it is preferred therefore to establish an opaque zone in the funnel region of the discharge vessel in order to provide a localized cooling to produce a better consistency in color temperature and color rendition index over the lamps' operating life. The size of the two opaque funnel regions of the discharge vessel, each consisting of a neck and stem, includes about 30% of the height of the respective hemispherical end 33 of the discharge vessel (neck) and extends approximately 5 mm into the adjacent capillary (stem). The funnel regions (upper and lower ends) are shown bounded by the dashed-line rectangles 29 in the FIGURE.

EXAMPLES

High purity (≧99.97% pure) $Al_2O_3$ powder was used as the starting powder. The powder contained finely divided $Al_2O_3$ particles with a crystallite size of 0.05 μm, a mean specific surface area of 30-6 $m^2$/g, and an average particle size of 0.45 μm. The sintering aids were based on the $MgO+ZrO_2+Y_2O_3$ system. The alumina powder was mixed with an organic binder to form the discharge vessel shape. Prefiring of the green shapes was conducted at 850-1350° C. in air to remove the organic binder.

In order to form the opaque zones, an aqueous solution containing 10 weight percent (wt. %) polyvinyl alcohol was painted onto the targeted area of the air-prefired discharge vessels using a small brush. The painted discharge vessels were placed in vacuum desiccator to allow the 10 wt. % polyvinyl alcohol-water solution to soak into the alumina and dry. These steps were repeated three times to fully impregnate the wall of the prefired discharge vessel. The painted parts were then placed vertically in a furnace and prefired under flowing nitrogen at 900° C. for 2 h (8° C./min ramp and 15° C./min cool-down). After the nitrogen prefiring, the impregnated areas appeared light gray, indicating residual carbon was effectively introduced.

The $N_2$-prefired, polyvinyl alcohol-impregnated discharge vessels were sintered in a moving belt furnace at 1850° C. in a dry $N_2$-8% $H_2$ atmosphere with a 1 g 10°/MgO—$Al_2O_3$ charge material. Another group of discharge vessels was fired in a static furnace under the following conditions: (1) a temperature cycle comprising increasing from 20° C. to 1415° C. over 1.5 hours, holding at 1415° C. for 30 minutes, increasing 1850° C. in 24 minutes, holding at 1850° C. for 3 to 4 hours, and then a 1 hour cool down, (2) a dry $H_2$ (dew point=−40° C.) atmosphere from 20° C. to 1415° C., a wet $H_2$ (dew point=0° C.) atmosphere from 1415° C., and (3) a 1 g 10°/MgO—$Al_2O_3$ charge material.

The opaque zones in the discharge vessels fired in the belt-furnace were readily apparent. However, the opaque zones in the discharge vessels fired in the static furnace although visible were relatively faint. The difference in the degree of the opaqueness is thought to be related to differences in the sintering atmosphere. In particular it is believed that the $H_2$ atmosphere in the static furnace caused more burnout of the residual carbonaceous material than the $N_2$-8% $H_2$ atmosphere in the belt furnace. The total transmittance values of the opaque-funnel discharge vessel were within 1% of the total transmittance (~99%) of standard translucent PCA vessels.

An analysis of the microstructure of polished cross section of the opaque funnel of a belt-furnace sintered PCA vessel found that residual pores about 1-5 μm in size are distributed inside grains within the wall of the funnel. The near-ID or OD-surface areas of the opaque neck are actually fully dense without pores, probably because of a high wind of dry $N_2$-8% $H_2$ sweeping immediately on the surfaces caused depletion of the un-burned carbon from the polyvinyl alcohol. The fully-dense surface layer means the wetting behavior of the lamp's molten salt fills, would be the same as that of the standard PCA funnel.

The spectral characteristics of two test lamps made with PCA discharge vessels having strong opaque zones in their funnel regions were compared with a group of control lamps. The data indicated a large reduction in color temperature spread (±CCT) at 1 hour of operation, (24K vs. 81K for the control group), but a moderate increase in ±CCT at 100 hours (74K vs. 57K for the control group). However, the change in CCT from 1 to 100 hours was less in the test lamps, 63K, than in the control group, 76K. Moreover, the Ra and R9 color rendering values at both 1 hour and 100 hours were significantly improved for the test lamps. At 1 hour, the Ra and R9 values were 91 and 31, respectively, for the test lamps versus 85 and −7, respectively, for the control group. At 100 hours, the Ra and R9 values were 92 and 42, respectively, for the test lamps versus 86 and 6, respectively, for the control group.

While there have been shown and described what are at present considered to be the preferred embodiments of the invention, it will be apparent to those skilled in the art that various changes and modifications can be made herein without departing from the scope of the invention as defined by the appended claims.

We claim:

1. A ceramic discharge vessel, comprising: a ceramic body made of a polycrystalline alumina, the ceramic body being translucent except for an opaque zone located in a predetermined region, the opaque zone having a scattering coefficient at 600 nm that is equal to or greater than 28 $cm^{-1}$.

2. The ceramic discharge vessel of claim 1 wherein the scattering coefficient at 600 nm is from 28 to 48 $cm^{-1}$.

3. A ceramic discharge vessel, comprising: a ceramic body made of a polycrystalline alumina, the ceramic body being translucent except for an opaque zone located in a predetermined region, the opaque zone having a pore population equal to or greater than $1\times10^6$ pores per $mm^3$.

4. The ceramic discharge vessel of claim 3 wherein the average pore size is about 2 μm.

5. The ceramic discharge vessel of claim 3 wherein the pore population is from 1 to $4\times10^6$ pores per $mm^3$.

6. The ceramic discharge vessel of claim 3 wherein the average pore size is about 2 μm.

* * * * *